US012303001B2

(12) United States Patent
Sun

(10) Patent No.: US 12,303,001 B2
(45) Date of Patent: May 20, 2025

(54) WATCH STRAP BUCKLE WITH HIDDEN LOCKING DEVICE

(71) Applicant: Shenzhen Eview GPS Technology, Shenzhen (CN)

(72) Inventor: Xiaoming Sun, Shenzhen (CN)

(73) Assignee: Shenzhen Eview GPS Technology, Shenzhen (CN)

( * ) Notice: Subject to any disclaimer, the term of this patent is extended or adjusted under 35 U.S.C. 154(b) by 89 days.

(21) Appl. No.: 18/122,729

(22) Filed: Mar. 17, 2023

(65) Prior Publication Data

US 2023/0218049 A1 Jul. 13, 2023

(30) Foreign Application Priority Data

Apr. 21, 2022 (CN) ..... 202220931101.0

(51) Int. Cl.
*A44C 5/20* (2006.01)

(52) U.S. Cl.
CPC ..... *A44C 5/2004* (2013.01)

(58) Field of Classification Search
CPC ... A44C 5/2004; A44C 5/2066; A44C 5/2052; A44B 24/266; Y10T 70/5009; Y10T 24/2192; Y10T 24/3411; Y10T 24/3419; Y10T 24/3495; Y10T 24/4037; Y10T 24/4009; Y10T 24/4007
See application file for complete search history.

(56) References Cited

U.S. PATENT DOCUMENTS 97,909 A * 12/1869 Greenwood ..... A44B 11/24 24/167
109,849 A * 12/1870 Stedman ..... A44B 11/24 24/167
292,372 A * 1/1884 Shaw ..... A44B 11/24 24/167
708,387 A * 9/1902 McLean ..... A44B 11/24 24/167
765,798 A * 7/1904 Spaulding ..... A44B 11/24 24/167
2,536,063 A * 1/1951 Kirsten ..... A44B 11/24 24/167
4,406,043 A * 9/1983 Friedman ..... A44B 11/006 24/182
4,419,792 A * 12/1983 Kohli ..... A44B 11/24 24/191

(Continued)

*Primary Examiner* — Jack W Lavinder
(74) *Attorney, Agent, or Firm* — Hemisphere Law, PLLC; Zhigang Ma

(57) ABSTRACT

The present disclosure discloses a watch strap buckle with a hidden locking device. The watch strap buckle includes a U-shaped snap ring; a rotating shaft is arranged at an open end of the U-shaped snap ring; one end of a buckle tongue is mounted on the rotating shaft, and the other end of the buckle tongue can be inserted into a watch strap hole; first limiting holes for the spring bolt to extend and retract are formed in left and right side surfaces of the box body; second limiting holes for the spring bolts to extend and retract are correspondingly formed in corresponding positions of left and right supports of the snap ring; and the watch strap buckle further includes an independent retraction actuation rod. The watch strap buckle is stable, reliable, convenient and practical.

5 Claims, 6 Drawing Sheets

(56) References Cited

U.S. PATENT DOCUMENTS 4,458,390 A * 7/1984 Fogelson ..... A44B 11/12 24/182
4,648,161 A * 3/1987 Rosen ..... A44C 5/2085 24/644
5,323,516 A * 6/1994 Hartmann ..... A44C 5/2071 24/303
5,787,554 A * 8/1998 Hashimoto ..... A44C 5/2052 24/71 J
5,875,523 A * 3/1999 Chen ..... A44B 11/006 24/191
6,023,816 A * 2/2000 Okada ..... A44C 5/24 24/71 J
6,108,821 A * 8/2000 Malsoute ..... A44B 11/008 2/338
6,145,169 A * 11/2000 Terzuola ..... A44B 11/005 24/191
7,480,967 B2 * 1/2009 Kojoori ..... G04B 37/1486 2/322
7,682,069 B2 * 3/2010 Hyatt ..... G08B 21/22 368/282
8,065,781 B2 * 11/2011 Chao ..... A61B 17/1327 254/365
8,935,834 B2 * 1/2015 Mouche ..... A44C 5/24 224/164
11,445,788 B2 * 9/2022 Viller ..... A44C 5/246
2014/0090213 A1 * 4/2014 Shikowitz ..... A44C 5/2085 24/587.12
2015/0366303 A1 12/2015 Pier
2016/0037898 A1 * 2/2016 Minn ..... A45F 5/02 24/604
2016/0324275 A1 11/2016 Buffa
2017/0215531 A1 * 8/2017 Wong ..... A44C 5/22
2019/0246750 A1 * 8/2019 Buonomo ..... A44C 5/24
2022/0087373 A1 * 3/2022 Kozak ..... A44C 5/2042

* cited by examiner

WATCH STRAP BUCKLE WITH HIDDEN LOCKING DEVICE

TECHNICAL FIELD

The present disclosure relates to a watch strap buckle, in particular to a pin buckle type watch strap buckle.

BACKGROUND

Because of its simple structure, a pin buckle type watch strap buckle has become a widely used watch strap fixing and connecting device. A basic structure includes a U-shaped snap ring. A rotating shaft or a spring bar needle is arranged at a root portion of the snap ring, namely, a U-shaped opening portion of the snap ring. When a buckle tongue is mounted on the rotating shaft or spring bar needle, the buckle tongue can freely shake or rotate within an angle of a certain range. After a watch strap passes through the snap ring, a function of fixing or fastening the entire watch strap is realized by inserting the buckle tongue into a watch strap hole formed in the watch strap, which is more convenient to operate.

The foregoing watch strap buckle often needs to be used in wearable intelligent equipment for monitoring information such as a geographic position and a physiological sign of a user in real time. However, during specific use, the user should cooperate and not unfasten the foregoing watch strap buckle without permission. Otherwise, the real-time monitoring function cannot be effectively realized. At this time, the pin buckle type watch strap buckle has a natural structural characteristic of being easily fastened and unfastened. This is a disadvantage that cannot be ignored. For example, the pin buckle type watch strap buckle is applied to a smartwatch for monitoring child's location and other information. If a child takes off the smartwatch at a will, the parents only know the location of the watch, and do not necessarily know the exact location of the child at this time. For another example, the pin buckle type watch strap buckle is applied to wristwatch type intelligent equipment for monitoring physical signs and specific location information of the elderly and mental patients. A user may not be able to cooperate in the whole process. The ordinary pin buckle type watch strap buckle may also be unfastened from the wrist by the user intentionally or unintentionally, thus completely losing the monitoring function.

For this reason, a common solution is that after the watch strap is fastened, an additional locking device is required to sleeve the watch strap buckle to prevent a user from loosening the watch strap and taking off the wearable intelligent equipment from the wrist without permission. This solution for adding a locking device has main defects as follows: 1. The structure is relatively complex and not compact. After the buckle tongue is inserted into the watch strap hole, the buckle tongue needs to be locked separately, which is inconvenient to use. 2 If the locking device is mounted outside the watch strap, unnecessary discrimination and other privacy leakage consequences may be caused.

SUMMARY

The present disclosure aims to provide a watch strap buckle with a hidden locking device, to solve the problems of inconvenience in use and leakiness of user's identity, privacy and other information in the prior art.

The present disclosure is implemented as follows: A watch strap buckle with a hidden locking device includes a U-shaped snap ring composed of a left support, a right support and a cross rod. A rotating shaft is arranged at an open end of the U-shaped snap ring; one end of a buckle tongue is mounted on the rotating shaft; the other end of the buckle tongue is inserted into a watch strap hole, thus fastening a watch strap; a locking box linked to the buckle tongue is further arranged at one end of the buckle tongue close to the rotating shaft; the locking box includes a box body and an upper cover; a connecting rod capable of extending and retracting left and right, and a spring bolt linked to the connecting rod are mounted in the box body; at least one first limiting hole for the spring bolt to extend and retract is arranged on a left side surface or a right side surface of the box body; at least one second limiting hole that corresponds to the first limiting hole and allows the spring bolt to extend and retract is also arranged at a corresponding position of the left support or the right support of the snap ring; the watch strap buckle further includes an independent retraction actuation rod; and the connecting rod or the spring bolt is retracted through the retraction actuation rod.

An abdication hole is formed in the upper cover of the locking box; after being connected with the connecting rod through the abdication hole, the retraction actuation rod drives the connecting rod and the spring bolt to retract from the limiting holes on the side surfaces of the support of the snap ring, thereby releasing the buckle tongue.

The second limiting hole arranged on the snap ring is a via hole; and the retraction actuation rod may be inserted from an open port of the via hole to push the spring bolt to retract from the second limiting hole, thereby releasing the buckle tongue.

A return spring is arranged at the other end of the connecting rod that is connected with the spring bolt; and the connecting rod pushes the spring bolt to be inserted into the second limiting hole through the return spring.

One first limiting hole is formed in each of the left side surface and the right side surface of the box body; one second limiting hole is formed in the corresponding position of each of the left support and the right support of the snap ring; two sets of connecting rods, return springs and spring bolts are mounted in the box body; one set of connecting rod, return spring and spring bolt are matched with the first limiting hole on the left side surface of the box body and the second limiting hole on the left support of the snap ring; and the other set of connecting rod, return spring and spring bolt are matched with the first limiting hole on the right side surface of the box body and the second limiting hole on the right support of the snap ring.

The two sets of connecting rods, return springs, positioning pin holes, positioning pins and spring bolts that are mounted in the box body are in centrosymmetric distribution; one positioning pin hole is formed in the middle of each connecting rod, and one positioning pin with a flange face is mounted in each positioning pin hole; a reset spring is mounted at a bottom of each positioning pin; the positioning pins may axially move up and down through the reset springs; tops of the positioning pins resist against the upper cover of the locking box; and when the spring bolts retract from the corresponding second limiting holes, the positioning pins are pushed by the springs, and the flange faces of the positioning pins resist against side surfaces of the positioning pin holes.

The upper cover is shafted to the box body, and the upper cover is fixedly connected to the tops of the positioning pins.

According to the watch strap buckle with a hidden locking device of the present disclosure, the locking box linked to the buckle tongue is provided. Due to the connecting rods and the spring bolts that are mounted in the box and can extend and retract left and right, when a watch strap is put on, the buckle tongue can be fixed and locked on the supports of the snap ring, which prevents a user from loosening the watch strap without permission and taking off wearable intelligent equipment from the wrist. Retraction and abdication of the spring bolts are realized manually through an independent special tool, namely, the retraction actuation rod, thereby releasing the buckle tongue and loosening the watch strap. During specific use, the wearing and fixing manners of the present disclosure are the same as those of an ordinary watch strap buckle. The locking box can be completely covered by a redundant portion of the watch strap and be hidden, and negative effects such as discrimination and leakage of user's identity and privacy information will not be caused. This watch strap buckle is stable, reliable, convenient and practical.

DETAILED DESCRIPTION OF THE EMBODIMENTS

In order to make the objectives, technical solutions and advantages of the present disclosure clearer, the present disclosure is further described in detail below with reference to accompanying drawings and embodiments. It should be understood that the specific embodiments described here are merely to illustrate and explain the present disclosure, and not intended to limit the present disclosure.

Figure 4:
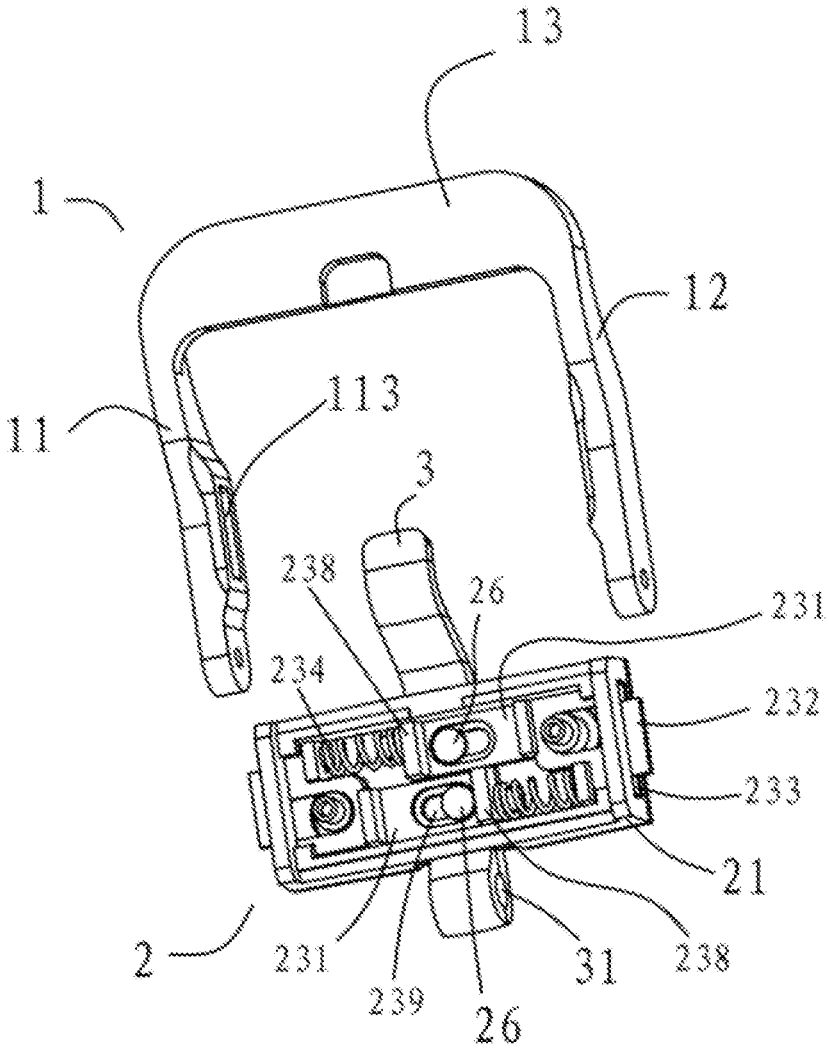
FIG. 4 is a structural exploded diagram of a buckle tongue and a snap ring in a watch strap buckle with a hidden locking device according to the present disclosure.
Figure 5:
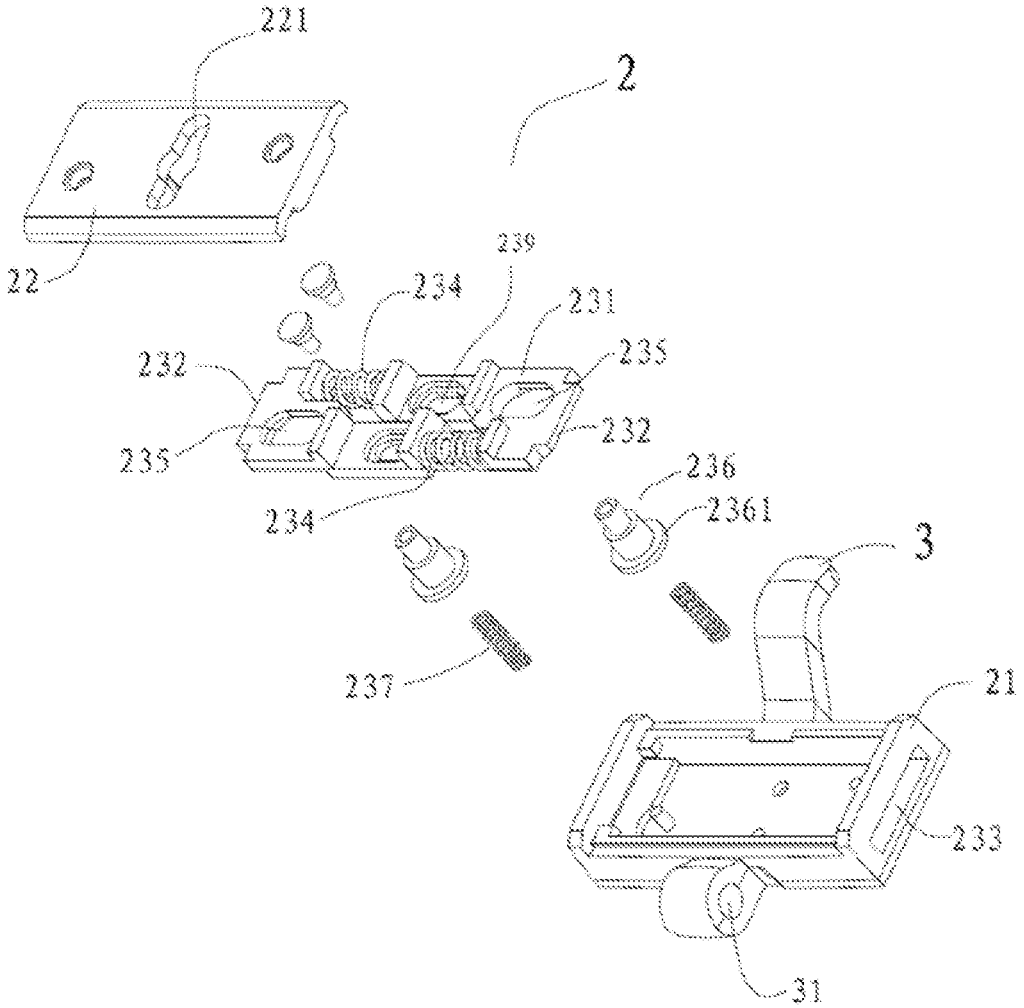
FIG. 5 is a structural exploded diagram of a locking box in the present disclosure.

Referring to FIG. 1 to FIG. 6, a watch strap buckle with a hidden locking device according to the present disclosure includes a U-shaped snap ring 1 composed of a left support 11, a right support 12 and a cross rod 13. A rotating shaft 14 is arranged at an open end of the U-shaped snap ring 1. One end of a buckle tongue 3 is mounted on the rotating shaft 14 in a normal way, such as through a pivot hole 31 as shown in FIG. 5. The rotating shaft 14 can be of a normally used spring bar needle structure. After the buckle tongue 3 is mounted on the rotating shaft or a spring bar needle, the buckle tongue can freely shake or rotate within an angle of a certain range, thereby fastening or releasing a watch strap 8.

Figure 6:
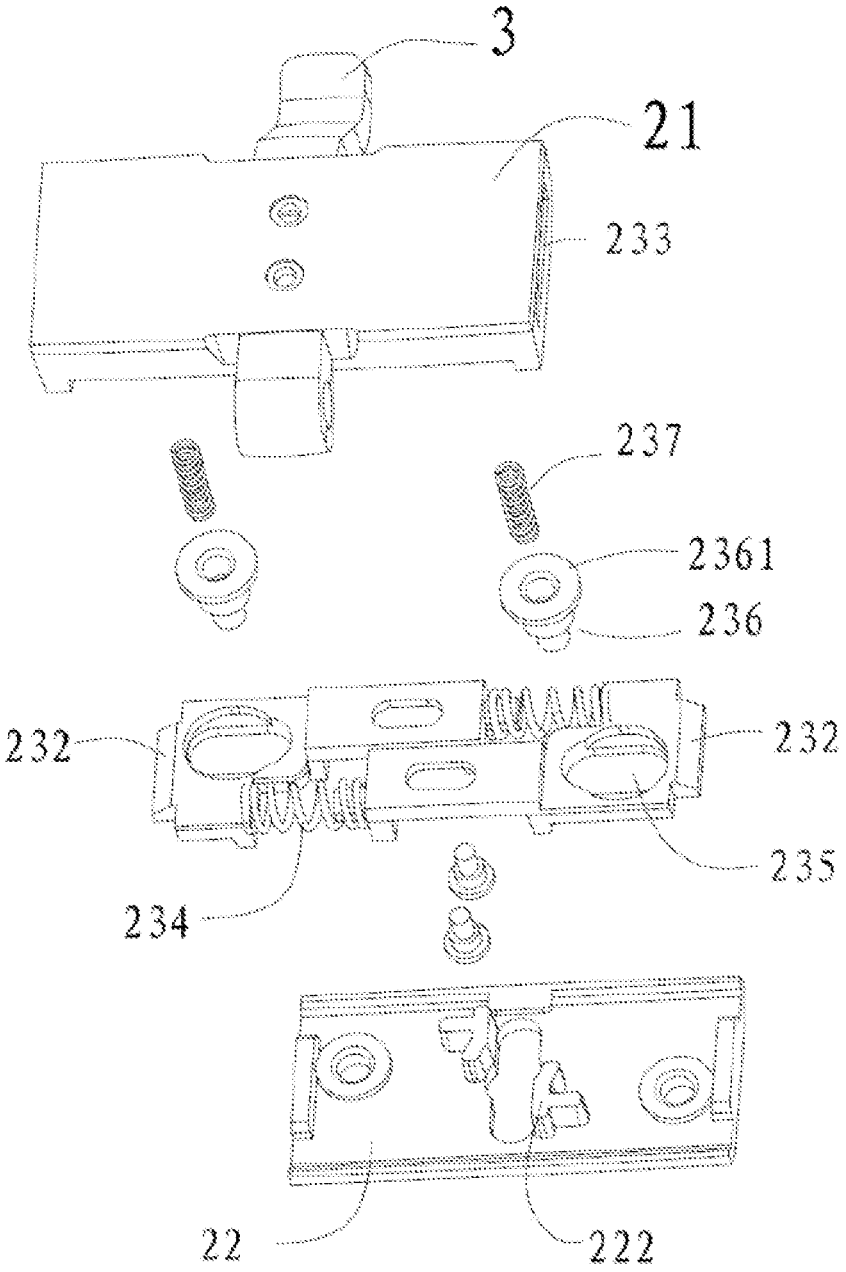
FIG. 6 is a structural exploded diagram after flipping in the state shown in FIG. 5.

The other end of the buckle tongue 3 can be inserted into the watch strap hole 81, thus fastening the watch strap 8. In the present disclosure, a locking box 2 linked to the buckle tongue 3 is mainly specially arranged at one end of the buckle tongue 3 close to the rotating shaft 14. The locking box 2 includes a box body 21 and an upper cover 22. A connecting rod 231 capable of extending and retracting left and right, and a spring bolt 232 linked to the connecting rod are mounted in the box body. The spring bolt 232 may be as shown in FIG. 6. A chamfer is arranged on one side of a front end, to facilitate extension and retraction. At least one first limiting hole 233 for the spring bolt to extend and retract is arranged on a left side surface or a right side surface of the box body 21. At least one second limiting hole 113 that corresponds to the first limiting hole 233 and allows the spring bolt to extend and retract is also arranged at a corresponding position of the left support 11 or the right support 12 of the snap ring. In this way, after the spring bolt 232 passes through the first limiting hole 233, the spring bolt further extends into the second limiting hole 113, and the buckle tongue 3 cannot freely shake or rotate any more. That is, the buckle tongue is limited and locked by the spring bolt, the first limiting hole and the second limiting hole. To release the buckle tongue 3 to release the watch strap 8, a special tool similar to a key function is used in the present disclosure. An independent retraction actuation rod is specially provided. The connecting rod 231 and the spring bolt 232 are manually retracted through the retraction actuation rod. That is, they are withdrawn from the second limiting hole 113 and the first limiting hole 233, mainly from the second limiting hole 113, thus loosening the buckle tongue 3.

Figure 1:
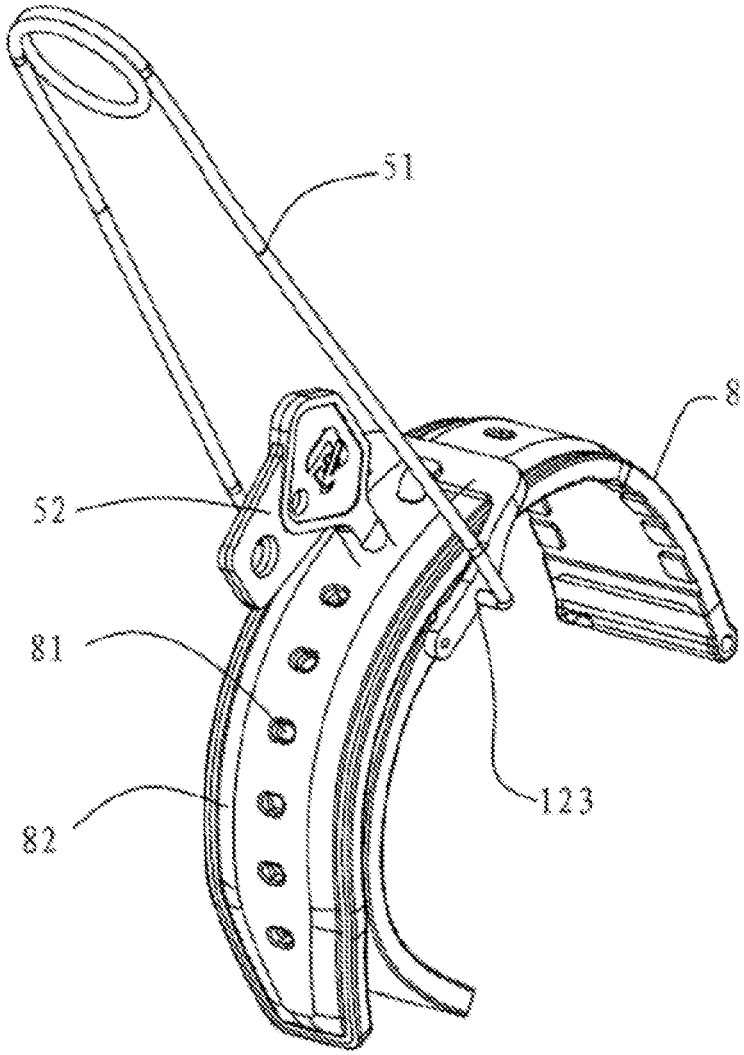
FIG. 1 is a schematic structural diagram of use of a retraction actuation rod of a watch strap buckle with a hidden locking device according to the present disclosure.
Figure 2:
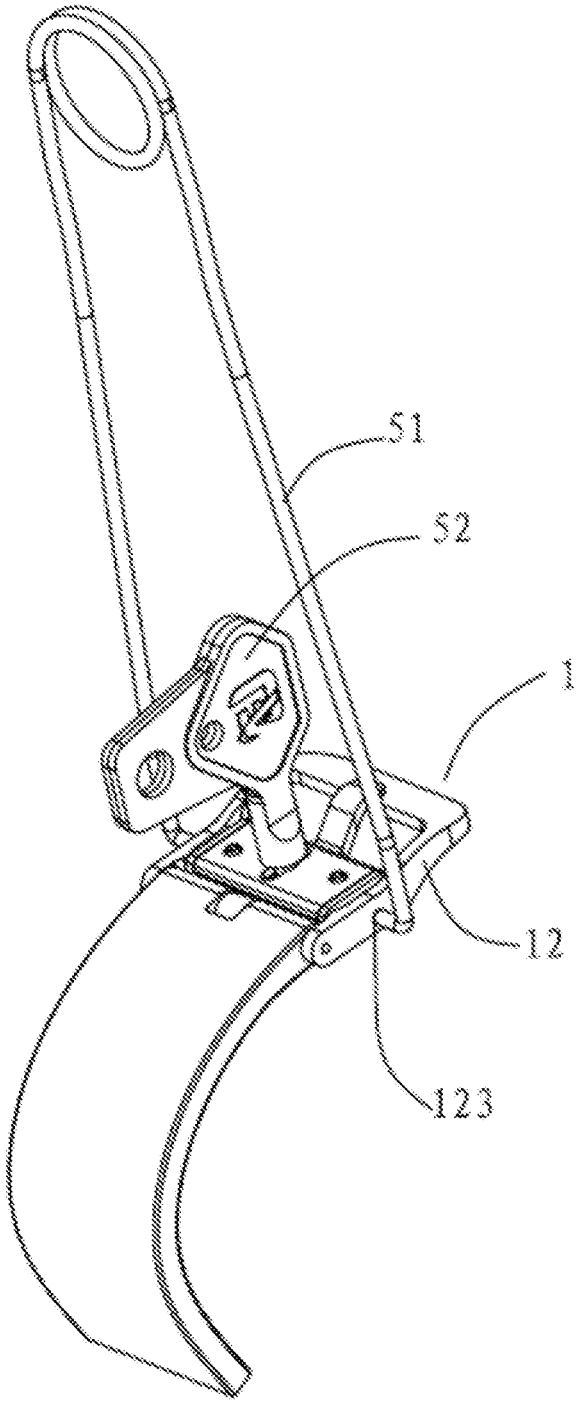
FIG. 2 is a schematic structural diagram of another state of use of a retraction actuation rod of a watch strap buckle with a hidden locking device according to the present disclosure.
Figure 3:
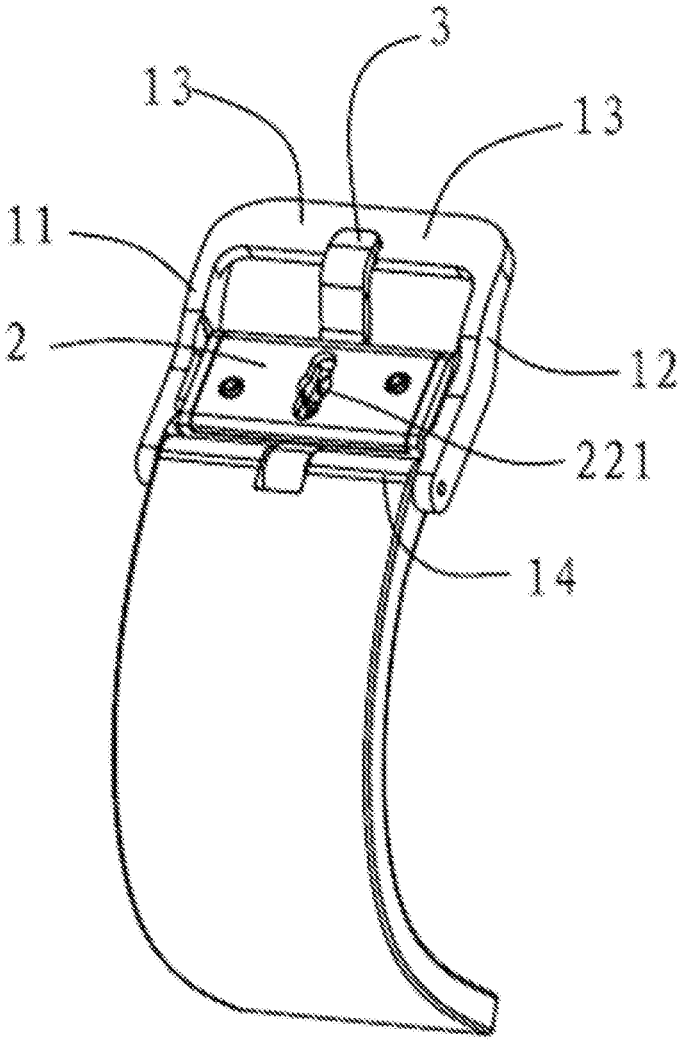
FIG. 3 is a schematic structural diagram of a watch strap buckle with a hidden locking device according to the present disclosure in a locked state.

FIG. 1 and FIG. 2 separately show two manners of releasing the buckle tongue. In the first manner, an abdication hole 221 is formed in the upper cover 22 of the locking box 2. The retraction actuation rod 52 similar to the key function extends into the locking box through the abdication hole 221 in the upper cover 22. After being connected to the connecting rod 231, the retraction actuation rod drives, in a conventional manual manner such as screwing, reverse toggling and magnetic suction, the connecting rod 231 and the spring bolt 232 to be retracted from the second limiting hole 113 of the support of the snap ring, thereby releasing the buckle tongue 3.

In the second manner of releasing the buckle tongue, all or part of the second limiting holes 113 formed in the left and right supports of the snap ring are via holes. The retraction actuation rod 51 of a clamping rod structure can be inserted from open ports 123 of the via holes to directly push, in a manual way, the spring bolt 232 to be retracted from the second limiting holes in the support of the snap ring, thereby releasing the buckle tongue 3.

It can be seen that the watch strap buckle is provided with a special tool, namely, a limiting rod, but no special restrictions are actually made to the shape and structure of the limiting rod, as long as the limiting rod is a rigid object, for example, a key-like structure in FIG. 1 and FIG. 2, or a simple clamping mechanism, and even only a rodlike object, and as long as the limiting rod can contact the connecting rod or the spring bolt and drive, in the conventional linkage way of screwing, toggling, magnetic suction or direct pushing, the connecting rod or the spring bolt, to pull out, withdraw or push out the spring bolt from the second limiting hole 113. The specific structure varies, and has a main function of being independent of the locking box, so that it is conveniently carried and controlled by other people, instead of being controlled or carried by a user wearing intelligent equipment such as a smart watch. In this way, the user cannot release the buckle tongue 3 and unfasten the watch strap 8 without permission, and take off the wearable intelligent equipment from the wrist at a will or it is inconvenient for the user to release the buckle tongue and unfasten the watch strap without permission, and take off the wearable intelligent equipment from the wrist at a will.

A return spring 234 is arranged at the other end of the connecting rod 231 that is connected with the spring bolt 232. The connecting rod 231 can automatically push and insert the spring bolt 232 into the second limiting hole 113 through the return spring 234.

During specific manufacturing of the watch strap buckle, one first limiting hole 233 may be formed in each of the left and right side surfaces of the box body 21. Similarly, one second limiting hole 113 is also formed in the corresponding position of each of the left support 11 and the right support 12 of the snap ring 1. Two sets of connecting rods, return springs and spring bolts are mounted in the box body 21, as shown in FIG. 4, FIG. 5 and FIG. 6. One set of connecting rod, return spring and spring bolt are matched with the first limiting hole on the left side surface of the box body and the second limiting hole; and the other set of connecting rod, return spring and spring bolt are matched with the first limiting hole on the right side surface of the box body and the second limiting hole. The foregoing two sets of locking structure are approximately in centrosymmetric distribution. As shown in FIG. 5, in this way, the locking box is symmetrically locked on the left support 11 and the right support 12 of the snap ring 1 from both sides, so that it is not easy to loosen the locking box. The performance of the locking box is still stable and reliable after long-time frequent use. The retraction actuation rod 52 is inserted into the abdication hole 221 in the upper cover 22 shown in FIG. 4 and FIG. 5 and is then connected to the two sets of connecting rods at the same time. The left and right spring bolts can be simultaneously directly withdrawn from the second limiting holes 113 in a screwing manner.

FIG. 4 and FIG. 5 further show a specific structure of a connecting rod: A convex pillar 26 is pre-arranged on the box body 21. The convex pillar 26 is sleeved by a through hole 239 formed in the middle of the connecting rod 231 in an aligned manner, so as to position the connecting rod. A baffle 238 is arranged at one end of the through hole 239 of the connecting rod 231 away from the spring bolt 232, so that it is convenient to manually twist or toggle the retraction actuation rod 52 to successfully withdraw the spring bolt 232 from the second limiting hole 113. It can be understood that the mechanical structures such as the connecting rod 231, the return spring 234, the convex pillar 26 and the through hole 239 shown in FIG. 4 can be replaced by other structures. For example, an elastic connecting rod of an integrated structure, or a connecting rod which is not elastic, but can extend and retract left and right and move in the box body 21 can basically realize the function of the watch strap buckle. The spring bolt cannot be withdrawn at a will or automatically after being freely inserted into the second limiting hole according to a wearing willingness of a user.

Due to a small physical space of the locking box of the present disclosure, the aforementioned positioning accessories such as the convex pillar are not necessary, but just an example. The reason is that in a small box space, these basic functions can still be realized as long as there is a redundant, necessary movement space in a left-right direction for the connecting rod in the locking box. All these simple changes, and connection relationships and cooperation relationships between all the relevant components still use the basic principle of the present disclosure, and of course, shall fall within the protection scope of the present disclosure.

In the present disclosure, one additional positioning pin hole 235 is arranged between each connecting rod and the corresponding spring bolt. One positioning pin 236 with a flange face 2361 is mounted in the positioning pin hole. A reset spring 237 is mounted at a bottom of the positioning pin. A top of the positioning pin 236 can resist against the upper cover 22 of the locking box 2. The upper cover 22 is movably pivoted with the box body 21. The positioning pin can move in an axial direction, namely, an up-down direction. A function of the positioning pin is as follows: When the spring bolt is retracted from the corresponding second limiting hole, the connecting rod is also retracted correspondingly. The positioning pin 236 is pushed by the reset spring 237, and the flange face 2361 of the positioning pin 236 can move up to resist against a side surface of the positioning pin hole 235, which restrains the return spring 234 from pushing the connecting rod and the spring bolt to move towards two outer sides or return. During specific manufacturing of the watch strap buckle, the tops of the positioning pins and the upper cover of the locking box can be welded and fixed together. At this time, the upper cover 22 and the box body 21 are fixedly connected together directly by the two positioning pins, without a specific pivot structure. That is, the two positioning pins are linked to the upper cover. Or, the upper cover and the box body can be mounted together. In this way, the upper cover and the positioning pins 236 can move up and down within a certain range. Of course, there are other ways to fix the positioning pins. For example, one end of the reset spring 237 is fixedly connected with the bottom of the box body 21, and the other end abuts against the bottom of the positioning pin 236. Connection and positioning can also be realized by various manners as shown in FIG. 6, such as by sleeving between positioning pillars, positioning pins and reset springs, and by inlaying the reset springs 237 in recesses formed in the bottoms of the positioning pins 236. In fact, in this structure, the two positioning pin holes 235 in the left and right ends and the upper cover welded together also achieve a certain positioning or limiting function. Requirements can be met as long as the positioning pins can slightly move up and down axially to achieve connection and cooperation relationships with the connecting rods.

As shown in FIG. 6, an outer edge of the positioning pin hole 235 is composed of two circular rings having different direct sizes and slightly deviated centers. The positioning pin 236 is provided with two layers of flange faces, one of which is large and the other one of which is small, respectively corresponding to the outer edges of the positioning pin hole 235 with different diameters. When the spring bolt 232 extends into the second limiting hole, the larger flange face 2361 of the positioning pin 236 does not contact the side surface of the positioning pin hole, which will not restrain the movement of the connecting rod 231. However, when the connecting rod 231 drives the spring bolt 232 to be retracted from the second limiting hole 113, the reset spring 237 pushes the positioning pin 236 to rise and move towards the upper cover, that is, to move up along an axial direction of the positioning pin. The flange face 2361 abuts against the outer edge of the positioning pin hole 235 to lock the connecting rod. At this time, the connecting rod 231 cannot be automatically reset.

In order to realize a locking function of the present disclosure more stably and to still reliably implement the various functions of the present disclosure after frequent locking or releasing, the two sets of connecting rods, return springs, positioning pin holes, positioning pins and spring bolts that are mounted in the box body are in centrosymmetric distribution.

The retraction actuation rod is inserted from the abdication hole 221 and is screwed. As shown in FIG. 4 and FIG.

5, the retraction actuation rod 52 is screwed counterclockwise to push the connecting rod 231 to move back, so that the connecting rod and the spring bolt are withdrawn from the second limiting holes, and unlocking succeeds.

The function of the baffle plate 238 is to toggle and drive the connecting rod more reliably. For the convenience of unlocking, a second baffle plate 222 can also be arranged on back surfaces of the connecting rod 231 and the through hole 239, as shown in FIG. 6, in a direction opposite to the baffle plate 238. The objective is as follows: After the retraction actuation rod 52 is inserted from the abdication hole 221 and connected with the connecting rod 231, the retraction actuation rod cannot be rotated in a reverse direction, or when the retraction actuation rod 52 is reversed (rotated clockwise), the retraction actuation rod cannot be screwed. In this way, it is more convenient if the retraction actuation rod 52 is used for unlocking.

When the present disclosure is specifically used, the spring bolt 232 is in a retracted state; the flange face 2361 of the positioning pin 236 abuts against the outer edge of the positioning pin hole 235; and the spring bolt will not move outward. The watch strap 8 passes through the snap ring 1. After a watch strap hole 81 with adequate tightness is found, the buckle tongue 3 is threaded into the watch strap hole 81. At this time, the upper cover 22 is slightly pressed, and the flange face 2361 of the positioning pin 236 slightly moves back. The return spring 234 pushes the connecting rod and the spring bolt to extend, that is, move outward, to be inserted into the second limiting hole from the first limiting hole 233, to lock the rotation of the buckle tongue. To release the buckle tongue, the independent retraction actuation lever 52 is screwed, or a retraction actuation lever of another structure is used, to manually force the connecting rod or spring bolt to be withdrawn from the second limiting hole. The positioning pin 236 is pushed by the reset spring 237, and the flange face 2361 abuts against the outer edge of the positioning pin hole 235 again to lock the connecting rod and spring bolt. It can be seen that when a user wears the watch strap 8, if it is found that the tightness of the watch strap hole 81 is inappropriate, as long as the upper cover 22 is not pressed, the locking box 2 is still not locked, and the buckle tongue can still rotate freely. The user can also reselect another watch strap hole. If the tightness is appropriate, the user then presses the upper cover or the positioning pin to achieve the final locking, which is very convenient to operate. The back surface of the locking box body 21 is flat, and the user does not have a feeling of foreign matters. The locked watch strap buckle will be completely covered by a redundant portion or a tail portion 82 of the watch strap, which is invisible to other people, so there will be no concerns about identity information leakage. This watch strap buckle is more popular. Putting on, unfastening, and other common operation manners of the watch strap buckle are the same as those of the ordinary pin buckle type watch strap buckle.

The above descriptions are only the preferred embodiments of the present disclosure, and are not intended to limit the present disclosure. Any modifications, equivalent replacements and improvements that are made within the spirit and principle of the present disclosure shall fall within the protection scope of the present disclosure.

What is claimed is:

1. A watch strap buckle with a locking device, comprising a U-shaped snap ring composed of a left support, a right support and a cross rod, wherein a rotating shaft is arranged at an open end of the U-shaped snap ring; one end of a buckle tongue is mounted on the rotating shaft; the other end of the buckle tongue is inserted into a watch strap hole, thus fastening a watch strap; the locking device comprises a locking box linked to the buckle tongue and arranged at the one end of the buckle tongue close to the rotating shaft; the locking box comprises a box body and an upper cover; at least one connecting rod capable of extending and retracting left and right, and a spring bolt linked to the at least one connecting rod is mounted in the box body; at least one first limiting hole for the spring bolt to extend and retract is arranged on a left side surface or a right side surface of the box body; and at least one second limiting hole that corresponds to the first limiting hole and allows the spring bolt to extend and retract is also arranged at a corresponding position of the left support or the right support of the U-shaped snap ring;

wherein an abdication hole is formed in the upper cover of the locking box; the abdication hole is used for allowing a retraction actuation rod to pass to drive the at least one connecting rod and to retract the spring bolt from the at least one second limiting hole on a side surface of the left support or the right support of the U-shaped snap ring, thereby releasing the buckle tongue.

2. The watch strap buckle with the locking device according to claim 1, wherein a return spring is arranged at an end of the at least one connecting rod, that is connected with the spring bolt; and the at least one connecting rod pushes the spring bolt into the at least one second limiting hole.

3. The watch strap buckle with the locking device according to claim 2, wherein the at least one first limiting hole is formed in each of the left side surface and the right side surface of the box body; the at least one second limiting hole is formed in a corresponding position of each of the left support and the right support of the U-shaped snap ring; the at least one connecting rod comprises a first connecting rod and a separate second connecting rod; the first connecting rod has a first return spring and a first spring bolt connected thereto; the second connecting rod has a second return spring and a second spring bolt connected thereto; the first and second connecting rods, the first and second return springs and the first and second spring bolts are mounted in the box body; the first connecting rod, the first return spring and the first spring bolt are aligned with the first limiting hole on the left side surface of the box body and the second limiting hole on the left support of the U-shaped snap ring; the second connecting rod, the second return spring and the second spring bolt are aligned with the first limiting hole on the right side surface of the box body and the second limiting hole on the right support of the U-shaped snap ring.

4. The watch strap buckle with the locking device according to claim 3, wherein two sets of positioning pin holes and positioning pins corresponds to the two sets of connecting rods, return springs, and spring bolts, the two sets of connecting rods, return springs, and spring bolts and the two sets of positioning pin holes and positioning pins are mounted in the box body in centrosymmetric distribution; one of the positioning pin holes is formed in each connecting rod, and one of the positioning pins is mounted in each positioning pin hole; a reset spring is mounted at a bottom of each positioning pin; the positioning pins axially moves up and down through the reset springs; tops of the positioning pins resist against the upper cover of the locking box; and when the spring bolts retract from the second limiting holes, the positioning pins are pushed by the reset springs, and flange faces of the positioning pins resist against side surfaces of the positioning pin holes.

5. The watch strap buckle with the locking device according to claim 1, further comprising an independent retraction actuation rod; and the spring bolt is retracted by the retraction actuation rod.

* * * * *